US007029375B2

(12) United States Patent
Phang et al.

(10) Patent No.: US 7,029,375 B2
(45) Date of Patent: Apr. 18, 2006

(54) RETAINING RING STRUCTURE FOR EDGE CONTROL DURING CHEMICAL-MECHANICAL POLISHING

(75) Inventors: Yew Hoong Phang, Singapore (SG); Jianguang Chang, Shanghai (CN)

(73) Assignee: Tech Semiconductor Pte. Ltd., Singapore (SG)

( * ) Notice: Subject to any disclaimer, the term of this patent is extended or adjusted under 35 U.S.C. 154(b) by 0 days.

(21) Appl. No.: 10/930,076

(22) Filed: Aug. 31, 2004

(65) Prior Publication Data

US 2006/0046621 A1 Mar. 2, 2006

(51) Int. Cl.
*B24B 1/00* (2006.01)

(52) U.S. Cl. ..... 451/41; 451/285; 451/348; 451/397

(58) Field of Classification Search ..... 451/41, 451/285–290, 398, 397, 60, 402
See application file for complete search history.

(56) References Cited

U.S. PATENT DOCUMENTS

| | | | | |
|---|---|---|---|---|
| 5,597,346 | A * | 1/1997 | Hempel, Jr. | 451/287 |
| 5,695,392 | A | 12/1997 | Kim | 451/288 |
| 5,944,593 | A | 8/1999 | Chiu et al. | 451/442 |
| 6,062,963 | A | 5/2000 | Lin et al. | 451/398 |
| 6,132,298 | A | 10/2000 | Zuniga et al. | 451/288 |
| 6,146,260 | A | 11/2000 | Yi | 451/398 |
| 6,183,350 | B1 * | 2/2001 | Lin et al. | 451/41 |
| 6,224,472 | B1 | 5/2001 | Lai et al. | 451/398 |
| 6,361,420 | B1 * | 3/2002 | Zuniga et al. | 451/288 |
| 6,419,567 | B1 * | 7/2002 | Glashauser | 451/259 |
| 6,436,228 | B1 | 8/2002 | Zuniga et al. | 156/345 |
| 6,447,380 | B1 | 9/2002 | Pham et al. | 451/288 |
| 6,869,335 | B1 * | 3/2005 | Taylor | 451/41 |

* cited by examiner

*Primary Examiner*—Lee D. Wilson
*Assistant Examiner*—Anthony Ojini
(74) *Attorney, Agent, or Firm*—George O. Saile; Stephen B. Ackerman

(57) ABSTRACT

The retaining ring has a plurality of slurry channels wherein each alternate channel is recessed away from the inner circumference of the pad contacting surface forming a recess which extends upward from the bottom surface sufficient to prevent contact of the retaining ring with the polishing pad. Each recess curves towards the inner circumference of the retaining ring in a manner to form a rounded tab, tangent to the inner circumference of the retaining ring, and meeting the inner circumference at the exit end of an adjacent non-recessed slurry channel. The total effective contact length of the ring with the wafer edge is about one-tenth of the wafer perimeter. This is sufficient to properly contain the wafer during polishing and provides a large area of undistorted polishing pad at the wafer edge. By adjusting the operating pressure of the polishing head, it is possible to obtain polishing rates at the wafer edge which are larger or smaller than the overall wafer polishing rate.

8 Claims, 15 Drawing Sheets

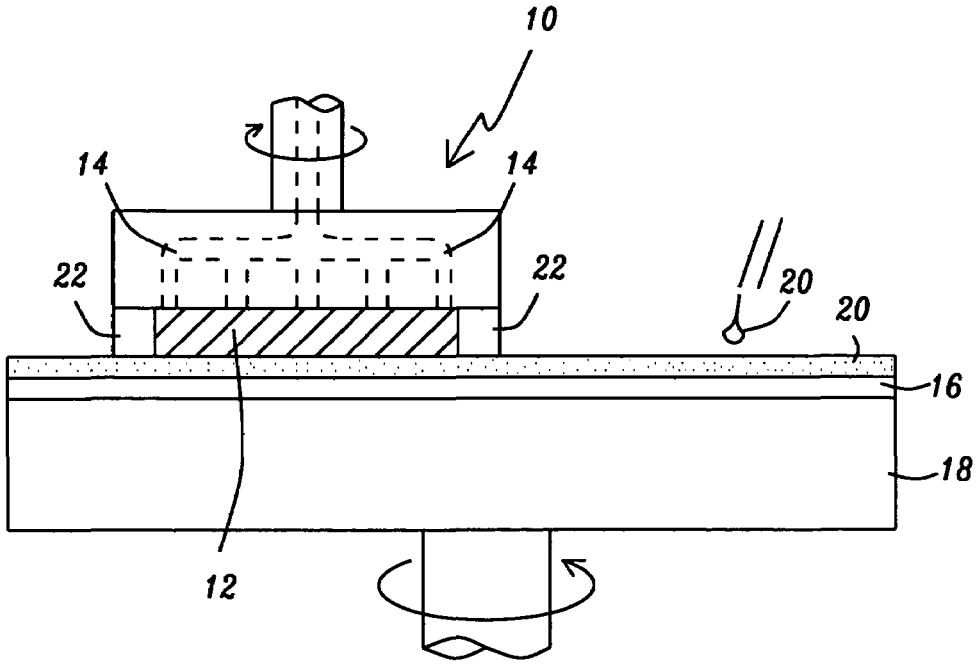
FIG. 1a – Prior Art
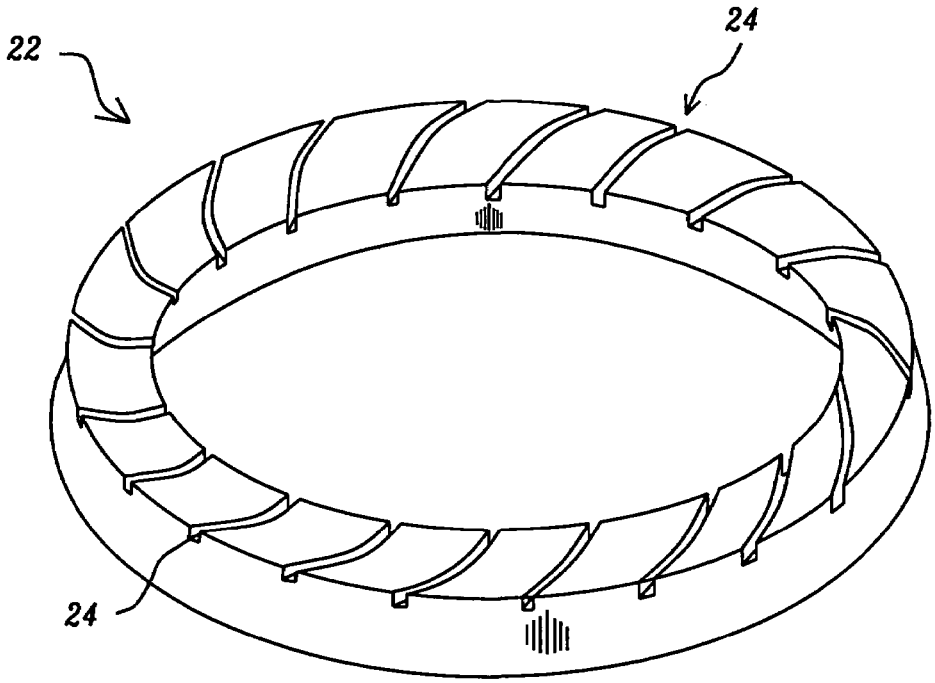
FIG. 1b – Prior Art

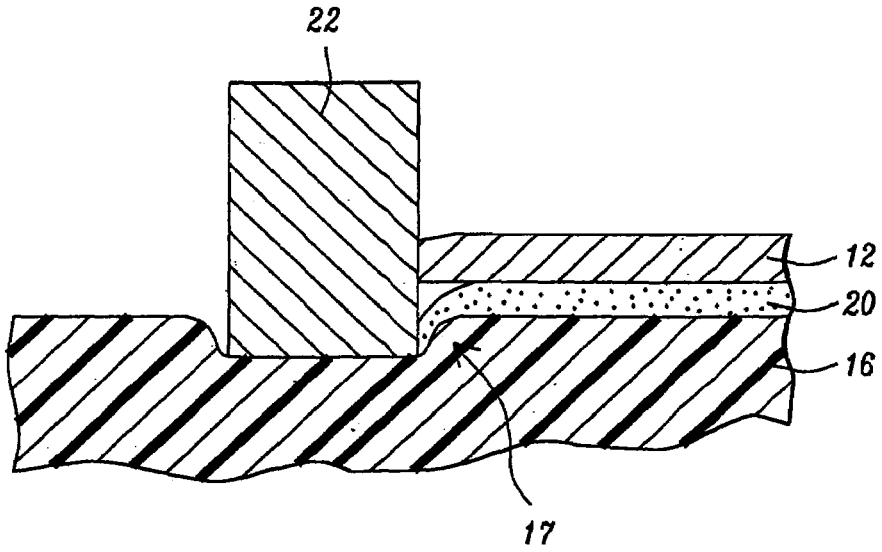
FIG. 2a – Prior Art
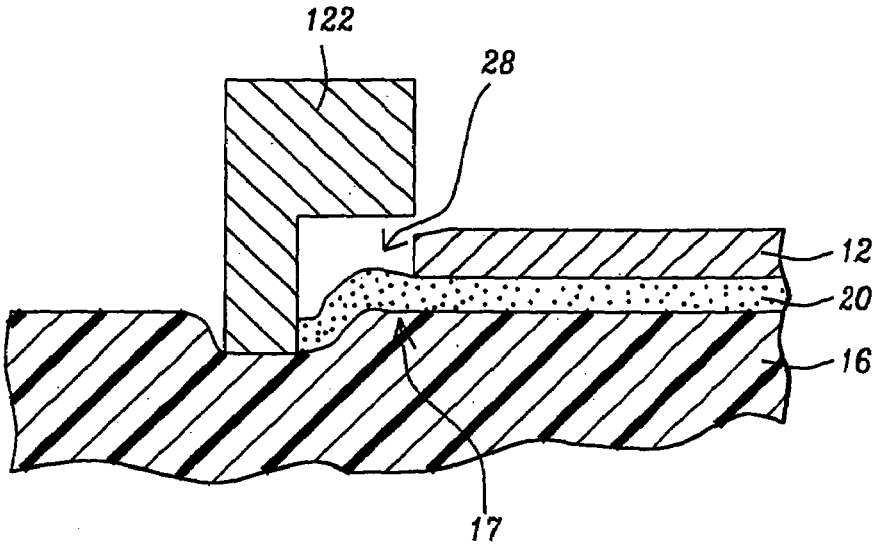
FIG. 2b

RETAINING RING STRUCTURE FOR EDGE CONTROL DURING CHEMICAL-MECHANICAL POLISHING

BACKGROUND OF THE INVENTION (1) Field of the Invention

The invention relates to processes for the manufacture of semiconductor devices and more particularly to the chemical-mechanical-planarization of semiconductor wafers.

(2) Background of the Invention and Description of Previous Art

The fabrication of integrated circuits not only involves the forming of semiconductor devices within the surface of a semiconductor wafer but also the creation of a complex network of wiring interconnections which comprise the electrical circuitry of the completed chip. These interconnections are accomplished by the alternate deposition of thin layers of conductive and insulating materials over the semiconductor devices. Each conductive layer is patterned by photolithographic techniques to form the wiring design for that level. This patterning process produces a surface with topological features, which, if no steps were taken, would replicate itself in each succeeding layer.

Conductive layers, usually metals such as aluminum or copper, are deposited by physical-vapor-deposition (PVD) techniques such as vacuum evaporation or sputtering. These methods do not provide conformal coverage and the presence of topological features on the surface onto which they are deposited result in non-uniformities in thickness and other problems related to the shadowing effects of non-planar surfaces.

Frequently two to four levels of interconnection metallurgy are required to form the required circuits. In order to provide a planar surface for each level of metal, various methods have been used to planarize the insulator surface. Glasses which flow when heated are commonly used to accommodate the first layer of metallization. Subsequent levels where elevated temperatures are no longer permissible, employ layers of materials which are deposited as liquids and then cured to form solid layers. Such layers of spin-on-glasses and organic polymers provide an improved local surface planarity. Subsequent reactive-ion-etching (RIE) removes the polymers and translates the new surface to the insulating layer.

Although these methods can provide to local planarization, they are impractical for the large wafers used present day technology because they cannot provide planarization over a large area. This is because the integrated circuit chips themselves contain discrete regions of different topological complexity such as memory arrays located within regions of logic circuits.

Recent years have seen an increased interest in the old technique which is used to provide the wafer with a planar surface in the first place—chemical-mechanical-polishing (CMP). At first thought, CMP is a seemingly crude method for dealing with dimensions of the order of hundredths of a micron. However, because of it's uniquely global planarizational ability, the CMP technique has been diligently and painstakingly refined and perfected for in-process planarization over the past decade. The main thrust of this effort has been dedicated to the development of highly sophisticated polishing machines. As a result, the CMP technique is now widely used for global planarization of in-process semiconductor wafers in the fabrication of integrated circuits.

Modern, high precision CMP machines are described, for example, by Hempel, U.S. Pat. No. 5,597,346, Kim, U.S. Pat. No. 5,695,392, Zuniga, et. al. U.S. Pat. Nos. 6,132,298 and 6,361,420 B1, Yi, U.S. Pat. No. 6,146,260, and Lin, et. al., U.S. Pat. No. 6,183,350 B1.

An example of a simple CMP polishing machine as described by Lai, et. al., U.S. Pat. No. 6,224,472 B1 is shown in FIG. 1*a* includes a head 10 which holds a wafer 12 to be polished on its under side, usually by vacuum applied to the back of the wafer 12 through numerous ports 14. The head 10 rotates and presses the wafer 12 against a polishing pad 16 mounted on an upright rotating pedestal or platen 18. A polishing slurry 20 is fed to the pad surface during operation. The underside of the head 10 is fitted with a retaining ring 22 which surrounds the wafer 12. FIG. 1*b* illustrates a typical retaining ring 22. The retaining ring 22 not only keeps the wafer 12 confined to the underside of the head 10 but also includes multiple channels 24 through which a polishing slurry 24 is introduced to the wafer/pad interface.

The polishing rate at wafer edge is usually different from that on the rest of the wafer. In addition, the polishing rate profile at the wafer edge does not vary much with different process parameters or materials being polished. Typically, the polishing rate at less than 5 mm. from the wafer edge is always lower than that at the wafer center. This puts a limitation on the thickness uniformity especially at the wafer edge that can be achieved by CMP and hence makes the wafer edge region unsuitable for use in integrated circuits, and decreases the yield.

It would be desirable to be able, by polishing parameter adjustments, to regulate the polishing rate in the edge region of the wafer so as to achieve a uniform polish rate over the entire wafer and thereby extend the overall usable area of the wafer. It would be further desirable to be able, by polishing parameter adjustments, to adjust the polishing rate in the edge region of the wafer so as to polish the wafer edge region at a significantly higher or a significantly lower rate than that over the main portion of the wafer. With this capability, either surface planarity and/or surface layer thickness uniformity can be extended further out into the edge region.

Zuniga, et. al., '298 and '420, describe a polishing head structure which provides adjustable pressure during polishing to the wafer in order to cause even polishing. A first pressure is applied to a center portion of the wafer through a membrane and a second pressure is applied to a perimeter portion of the wafer through an edge load ring which is more rigid than the membrane. In Zuniga, et. al., U.S. Pat. No. 6,436,228 B1, there are shown a wafer substrate retaining ring which provides a plurality of discrete points of contact between the ring and the wafer. However, these various designs do not address the delivery of slurry under the wafer.

Notable progress has been made in retaining ring design, primarily with regards to the uniform and controllable flow of slurry past the retaining ring to the underside of the wafer. Chiu, et. al., U.S. Pat. No. 5,944,593 shows a retaining ring which features a plurality of straight channels for the delivery of a slurry and an added circular groove which provides an internal interconnection of all the straight channels. This design provides a buffering effect to the delivery of slurry. Lin, et. al., U.S. Pat. No. 6,062,963 cites the use of slurry delivery channels which are tapered to even out the slurry flow at the edge of the wafer. Glashauser, U.S. Pat. No. 6,419,567 B1 also provides an improved slurry delivery system through the retaining ring with a central circular channel in the base of the retaining ring which is fed with slurry through two inlets and which distributes slurry to the wafer through a plurality of inner channels. Pham, et. al., U.S. Pat. No. 6,447,380 B1 like Glashauser, also addresses modifications of the retaining ring to improve slurry delivery to the wafer.

While most of the retaining ring design effort has directed at slurry delivery, little has been given towards edge control. The Mirra-Mesa™ polisher manufactured by Applied Materials Corporation of Palo Alto, Calif. permits the application of a first pressure to the backside of the wafer during polishing through a flexible membrane (designated as membrane pressure or MP). A second pressure, designated as retaining ring pressure (RRP), is applied to a retaining ring which surrounds and confines the wafer. A third pressure, referred to as inner tube pressure (ITP), permits the application of an additional controllable downward pressure to a circular region near the edge of the wafer by means of an inflatable tube, between the membrane and the wafer. With this capability, the present inventors have found that, using the conventional retaining ring shown if FIG. 1*b*, for several values of inner tube pressures (ITP) at a fixed retaining ring pressure (RRP) the polishing rate always dropped off within the outermost 5 mm. edge portion of a 200 mm. wafer.

In response, the present inventors have developed a new retaining ring design which permits edge polishing rates which can be made significantly greater or significantly less than the mean overall wafer polishing rate depending on the choice of ITP and RRP. None of the prior art provides the capability of such wafer edge polishing rate adjustment by a simple in-situ pressure change. In view of the above the improved retaining ring structure cited by the present invention helps to minimize deformation of the polishing pad and thereby is capable of providing good thickness uniformity and/or surface planarity over a greater portion of the wafer than was previously possible.

SUMMARY OF THE INVENTION

It is an object of this invention to provide a design of a CMP wafer retaining ring which provides a uniform slurry delivery to a wafer contained therein.

It is another object of this invention to provide a design of a CMP wafer retaining ring which provides secure wafer containment with minimal wafer edge contact.

It is yet another object of this invention to describe a design of a CMP wafer retaining ring which provides minimal polishing pad distortion at or near the edge of a wafer contained therein when downward pressure is applied to said retaining ring.

It is yet another object of this invention to describe a design of a CMP wafer retaining ring which provides the capability of instantaneously manipulating the polishing rate of the edge region of a wafer by adjusting both the retaining ring pressure and the wafer pressure against the polishing pad to make the edge polishing rate either significantly greater than or significantly less than the main wafer polishing rate.

These objects are accomplished by a retaining ring design having a plurality of straight slurry delivery groves, angled in the direction of rotation of said ring wherein each alternate channel is recessed away from the inner circumference of the bottom, pad contacting, surface, of said retaining ring by a recess which extends upward from the bottom surface only sufficiently to prevent contact of the retaining ring with the polishing pad in the area of the recess. Each recess curves outwardly towards the inner circumference of the retaining ring in a manner to form a symmetrical segmented tab with a rounded edge, tangent to the inner circumference of the retaining ring, and meeting the inner circumference at the exit end of an adjacent non-recessed slurry channel.

Each segmented tab contacts the enclosed wafer over a distance, which includes the width of the slurry channel exit, which is about 11.5 percent of the contact distance of a comparable un-recessed retaining ring.

It is another object of this invention to provide a method for improving the thickness uniformity and/or surface planarity of a surface layer on a wafer, wherein the surface layer initially exhibits radially symmetrical non-uniform thickness or planarity between its edge region and its interior region.

This object is accomplished by first depositing or otherwise forming a desired surface layer to a thickness which is greater than or equal to the desired final thickness in both edge and interior regions. The wafer is then mounted on the head of a CMP apparatus which is fitted with a wafer retaining ring having a recessed face as cited supra and will be described in greater detail in the first embodiment of this invention. The CMP apparatus must also has the capability of selectively and independently applying downward pressure (ITP) onto back of a wafer edge, (MP) onto the wafer bulk, and (RRP) onto the retaining ring. Prior to said mounting, the CMP apparatus must first have been calibrated to determine the polishing rates of a corresponding surface layer on a calibration wafer as a function of the ITP and RRP. It will be found that under one set of parameters the edge polish rate will be significantly greater than that over the interior region of the wafer. For another set of parameters the edge polish rate will be significantly less than that over the interior region of the wafer.

The surface layer of the wafer is then polished, using a set of parameters which will polish the thicker region at a faster rate than the thinner region. A point will then be reached when the edge region and the interior region of the surface layer are essentially of the same thickness or the upper surface of the layer is essentially planar. If upper layer overall thickness uniformity is sought, the upper surface is not necessarily planar. However, if the wafer surface was planar overall before deposition of the surface layer, both layer thickness and surface planarity will be realized. Finally, if necessary, the polish parameters are the switched to a set which gives the same polish rate for the edge region and the interior region. The surface layer is then uniformly polished down to the final desired thickness.

BRIEF DESCRIPTION OF THE DRAWINGS

FIG. 1*a* is a cross section showing a prior art example of the components of a chemical mechanical polishing station.

FIG. 1*b* is an isometric view of a prior art example of a wafer retaining ring for a chemical mechanical polishing station fitted with slurry delivery channels.

FIGS. 2*a* thru 2*b* are cross sectional views of an in-process wafer undergoing CMP which illustrate the structure and mechanism of the embodiments of the present invention compared to a corresponding prior art configuration.

DESCRIPTION OF THE PREFERRED EMBODIMENTS

Figure 3A:
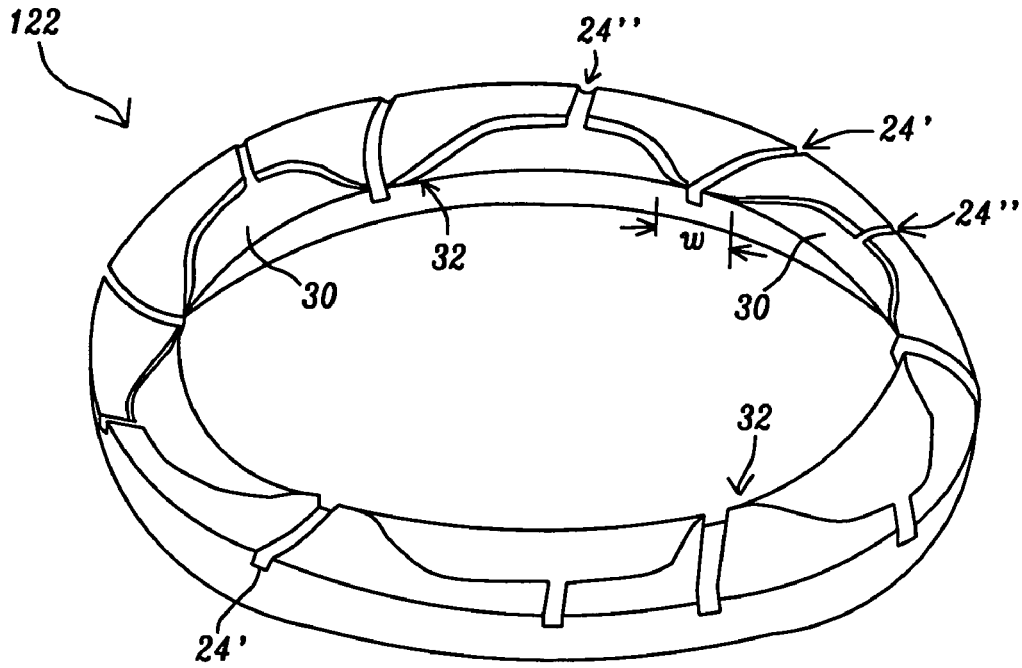
FIG. 3*a* is an isometric view of a novel wafer retaining ring for a chemical mechanical polishing station fitted with slurry delivery channels and having alternating recesses and tabs according to the teaching of the present invention.

In a first embodiment of this invention a design of a retaining ring for a CMP head is described. The embodiment will be geared towards polishing an oxide layer on a 200 mm. diameter standard silicon wafer. The head of the CMP machine will therefore be discussed in terms of this size wafer. However, the embodiment is not limited to a 200 mm. wafer but may be applied to any wafer size.

Experimental data will be presented in which the performance of the novel retaining ring is compared to the performance of the prior art retaining ring design shown in FIG. 1*b*. The CMP machine used to obtain the data for both old and new retaining ring design was a Mirra-Mesa™ polisher manufactured by Applied Materials Corporation of Palo Alto, Calif. The polisher was fitted with Titan-1 polisher heads which permit the application of a first pressure to the backside of the wafer during polishing through a flexible membrane and a second pressure to a retaining ring which surrounds and confines the wafer. The polisher was outfitted with Nano9000™ in-situ thickness metrology, used to determine the polishing rates. The slurry and the polisher pad used in the evaluation were the ILD1300 slurry and the OXP4100 polisher pad supplied by Rodel Inc. of Phoenix Ariz. The pad conditioning disks used in the experiments were Fujimori diamond dresser SD-100P.

FIG. 2*a* is a cross section of a conventional retaining ring 22, such as that illustrated in FIG. 1*b*, pressed against a polishing pad 16 causing a depression of the polishing pad. The edge of wafer 12 is essentially butted against the retaining ring 22. Under the edge 17 the wafer the distance between the wafer and the polishing pad 16 is greater than that over the rest of the wafer. While the entire space between the wafer and the polishing pad may still be filled with slurry 20, the polishing pad has essentially lost contact with the wafer under the edge. Consequently, the polishing rate would be expected to be significantly diminished at the wafer edge. This is what was found, over the entire range of inner tube pressures examined, regardless of the value of RRP.

In order to overcome the distortion of the polishing pad by the retaining ring at the edge of the wafer, and thereby improve polishing rate control in the edge region, the retaining ring design was modified to recess the area of contact of the retaining ring away from the wafer edge. Referring now to FIG. 2*b*, a cross section of the redesigned retaining ring 122 is shown. Here the polishing pad 16 is in continuous uniform contact with the wafer 12 all the way out to the wafer edge 17. Obviously, if the retaining ring 122 were recessed along it's entire inner circumference, it's ability to restrict the wafer movement would be compromised. To overcome this, redesigned retaining ring 122 is provided with regions along it's bottom inner circumference which are not recessed.

FIG. 2*b* also shows the effect of wafer pressure on the polishing pad 16 in the region where the retaining ring 122 is undercut according to the teaching of the present invention. Downward pressure of the wafer 12 causes the polishing pad to rise above the edge of the wafer 12. This suggests that the polishing rate at the very edge of the wafer 12 would be greater than the overall rate. Indeed, a higher edge polishing rate is found under conditions where the inner tube pressure ITP is high. The ITP presses down the edge region of the wafer.

Figure 3B:
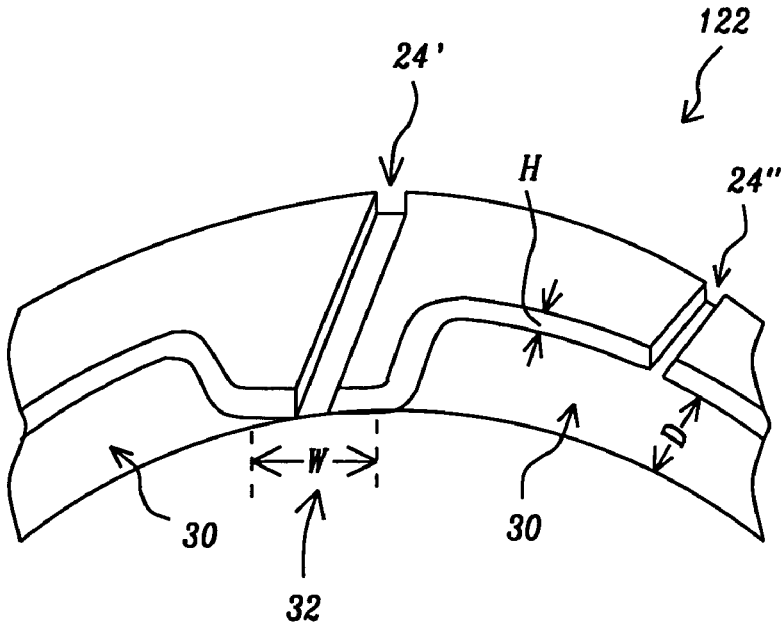
FIG. 3*b* is an isometric view of a portion of the novel wafer retaining ring illustrated in FIG. 3*a*, showing one segmented tab encompassing a long slurry delivery channel with an adjacent recess with an adjacent short slurry delivery channel according to the teaching of the present invention.

The most desirable configuration of the recessed edge retaining ring of the present invention is shown in isometric view in FIG. 3*a* where alternate slurry channels 24' are recessed and enclosed by symmetrical rounded tabs 32 which engage and thereby confine the wafer under the polishing head. FIG. 3*b* shows an enlarged and more planar view of a portion of the novel retaining ring to illustrate recessed regions 30 and a segmented rounded tab 32 which has an effective contact width "W". Slurry delivery is also believed to be enhanced by this design, having now channels of alternating lengths 24' and 24". The preferred effective contact width "W" for a retaining ring for a 200 mm. diameter wafer is between about 8 and 16 mm. If an alternate means to assist securing the wafer is used, the contact width "W" may be made even smaller than 8 mm. without sacrificing the ability of the retaining ring to satisfactorily confine the wafer.

Experiments were also performed on segmented contacts which were not rounded but had a square off outer face straddling the slurry channel. However, the squared corners were found to chip away during polishing and therefore this option was not pursued.

The improved retaining ring 122 illustrated in FIGS. 3*a,b* is preferably fabricated of a plastic material such as polyphenylene sulfide. The height "H" of the recesses 30 is preferably between about 1 and 3 mm. The preferred depths "D" of the recesses at the exit of the slurry channels 24" is about half the total thickness "t" of the retaining ring 122. The improved retaining ring 122 for a 200 mm. diameter wafer preferably has about 12 total slurry channels.

Experiments were performed to evaluate the improved retaining ring design. For these experiments a standard retaining ring of the type shown in FIG. 1*b* with 12 slurry channels was used. The improved retaining ring, fashioned according to the design in FIG. 3, had six long slurry channels 24', six short slurry channels 24" and six symmetrical segmented rounded tabs 32. For a 200 mm. diameter wafer and a segment length "W" of 12 mm. the total wafer contact length, defined as W time the number of segmented tabs, is only 11.5 percent of the inner circumference of the retaining ring. The preferred total wafer contact length is between about 7 and 15 percent of the inner circumference of the retaining ring. If an alternate means to assist securing the wafer is used, the contact length can be even less than 7 percent without sacrificing the ability of the retaining ring to satisfactorily confine the wafer.

With this arrangement the polishing pad is free of distortion by the retaining ring, as illustrated in FIG. 2*b*, over 88.5 percent of the time. The improved retaining ring used in the experiments had a recess depth "D" of about 12 mm. and recess height "H" of about 2 mm. The wafer thickness was about 0.7 mm. The recess height "H" is preferably always greater than the wafer thickness.

The wafers used in the polishing experiments were conventional 200 mm. diameter silicon wafers, each with a 10 micron thick blanket layer of silicon oxide deposited on their surface by chemical vapor deposition (CVD). The thickness of the oxide layer on each wafer was measured at many locations on the wafer before and after polishing using the Nano9000 thickness measurement capability of the CMP polisher. The tool is capable of measuring thicknesses out to about 99.5 mm. from the wafer center which is essentially the very edge of the wafer. The polishing rate was then plotted for the many measurement locations as a function of distance from the center of the wafer. The polishing slurry and pad were the ILD1300 slurry and the OXP4100 polisher pad respectively.

FIGS. 4*a*, 4*c*, 4*e*, 4*g*, and 4*i* are experimental plots of oxide removal rate versus distance from the center of the wafer to the edge of the wafer for different inner tube pressures ITP and a constant RRP of 3.5 psi. using the conventional retaining ring The corresponding experimental plots for polishing wafers using the improved retaining ring 122 supra are shown in FIGS. 4*b*, 4*d*, 4*f*, 4*h*, and 4*j*. The polishing parameters used in all cases are given in Table I.

TABLE I

| Experimental parameters for CMP | |
|---|---|
| Platen speed | 110 rpm. |
| Head speed | 104 rpm. |
| Membrane pressure (MP) | 3.0 psi. |
| Slurry flow | 100 ml./min. |
| Polishing time | 60 seconds |
| Retaining ring pressure (RRP) | 3.5 psi and 4.5 psi. |
| Inner tube pressure (ITP) | 1.5 psi to 5.5 psi in 1 psi. intervals |

Similar trends of polish rate profiles were observed for standard retaining ring and improved retaining ring when the RRP is fixed at 4.5 psi. These results are presented for the standard retaining ring in FIGS. 5*a*, 5*c*, 5*e*, 5*g*, and 5*i* and for the improved retaining ring in FIGS. 5*b*, 5*d*, 5*f*, 5*h*, and 5*j*.

Figure 4A:
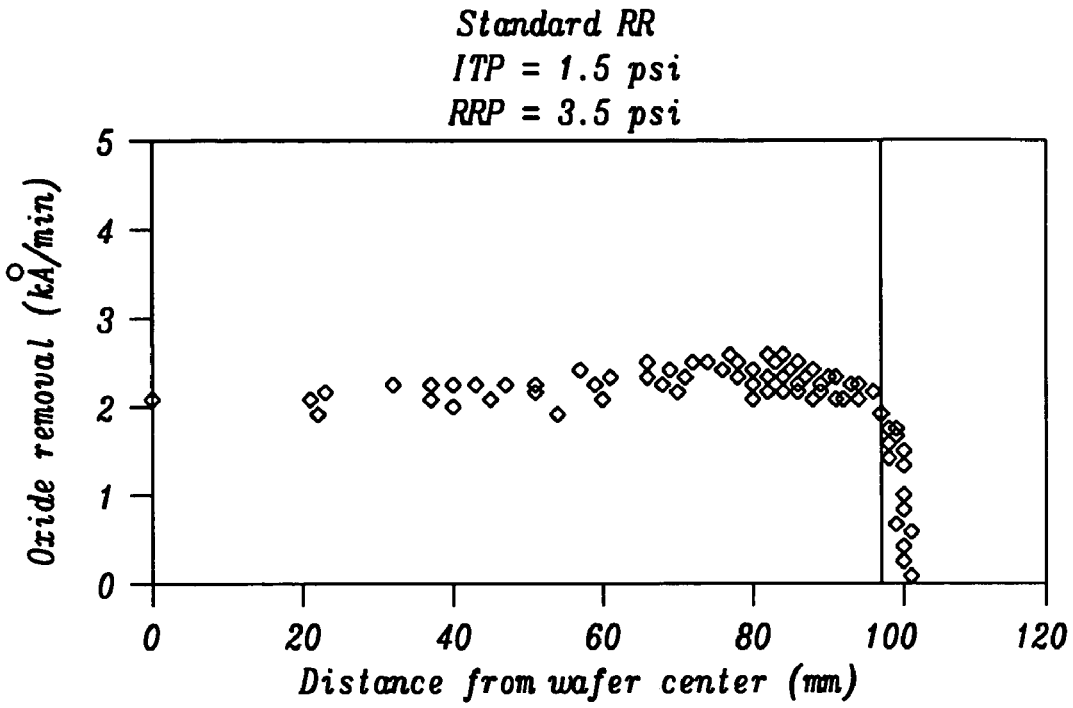
FIGS. 4*a*, 4*c*, 4*e*, 4*g*, and 4*i* are graphs showing polishing rate as a function of distance from the center of a 200 mm. wafer after CMP using a several values of inner tube pressure and a standard retaining ring with 12 slurry channels at a retaining ring pressure of 3.5 psi.
Figure 4B:
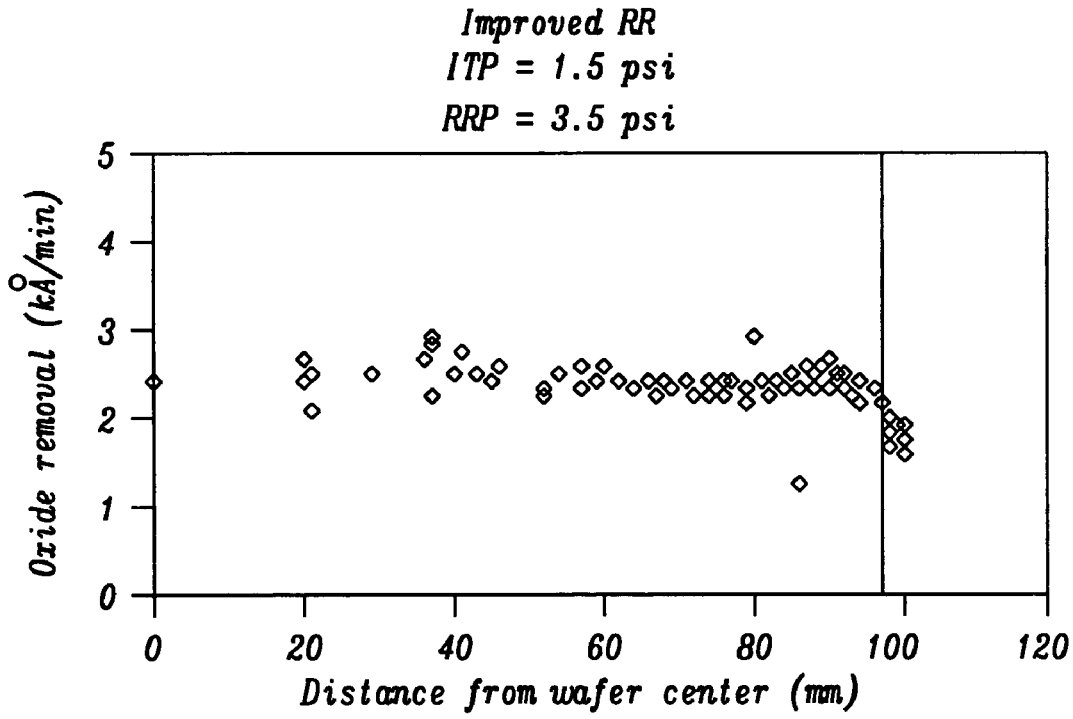
FIGS. 4*b*, 4*d*, 4*f*, 4*h*, and 4*j* are graphs showing polishing rate as a function of distance from the center of a 200 mm. wafer after CMP using a several values of inner tube pressure and the improved retaining ring illustrated in FIG. 3 with 12 slurry channels at a retaining ring pressure of 3.5 psi.
Figure 4C:
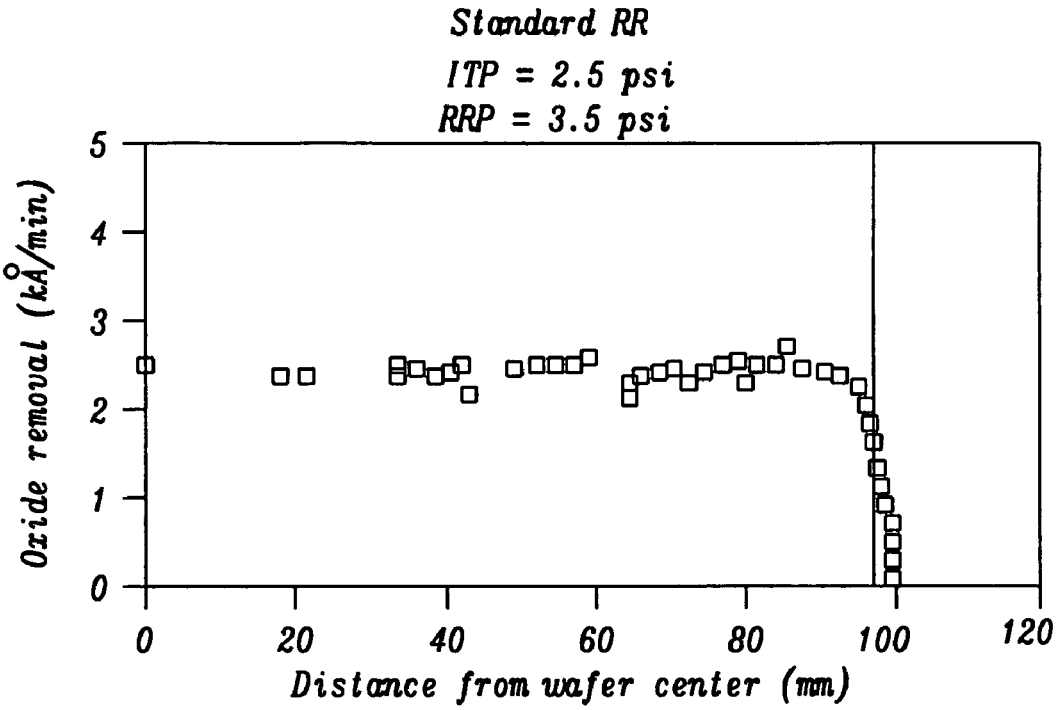
Figure 4D:
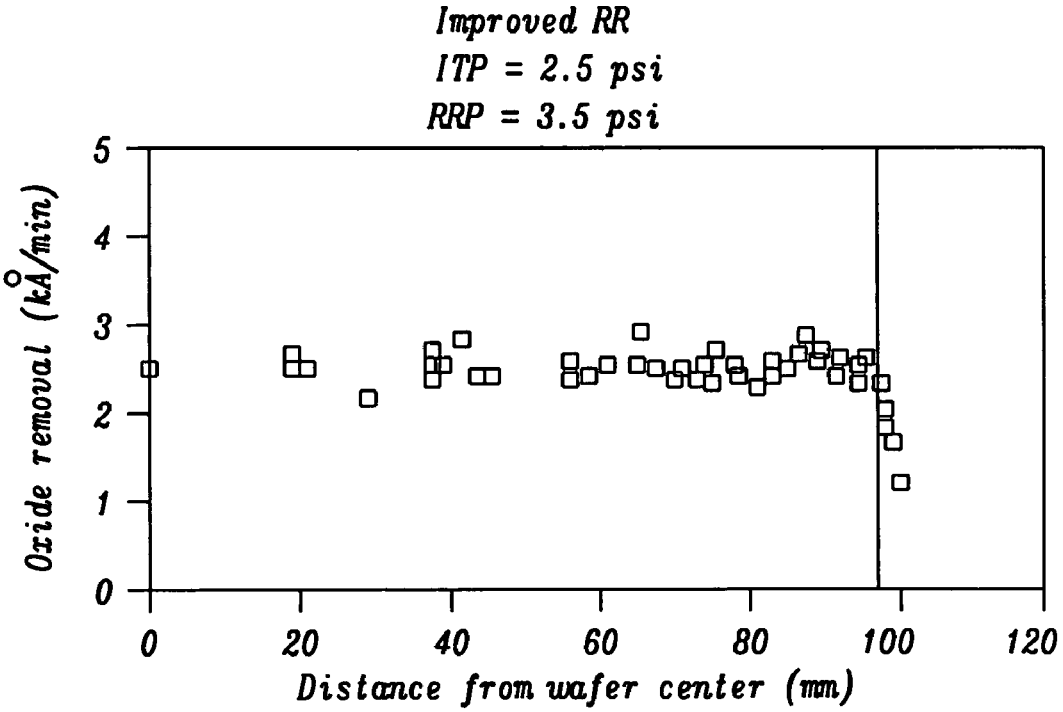
Figure 4E:
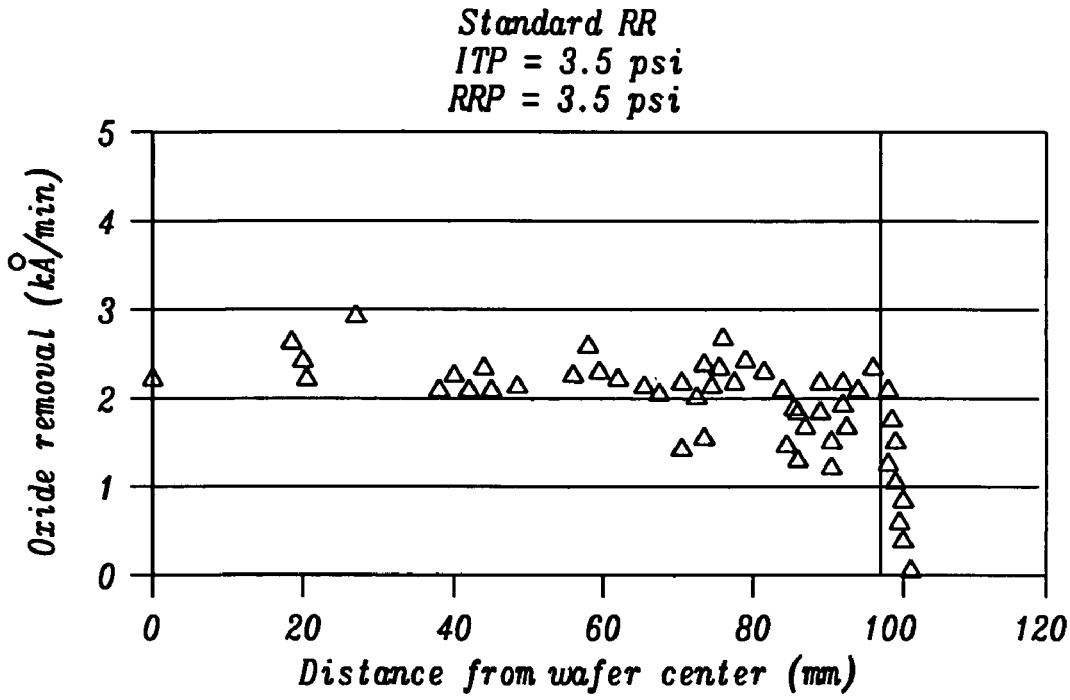
Figure 4F:
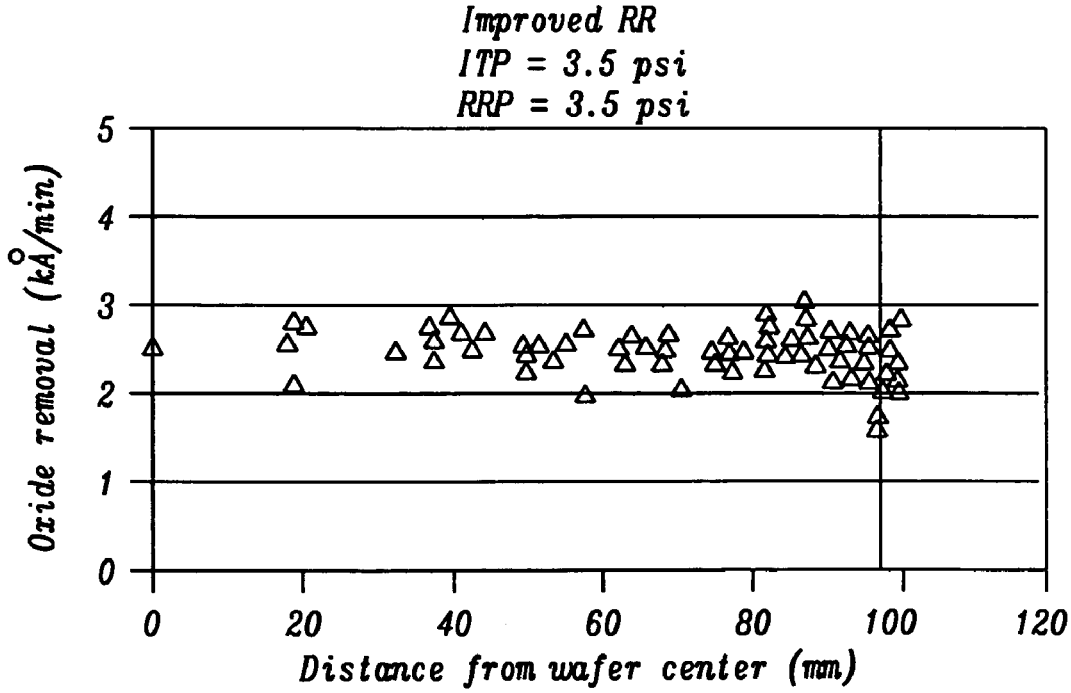
Figure 4G:
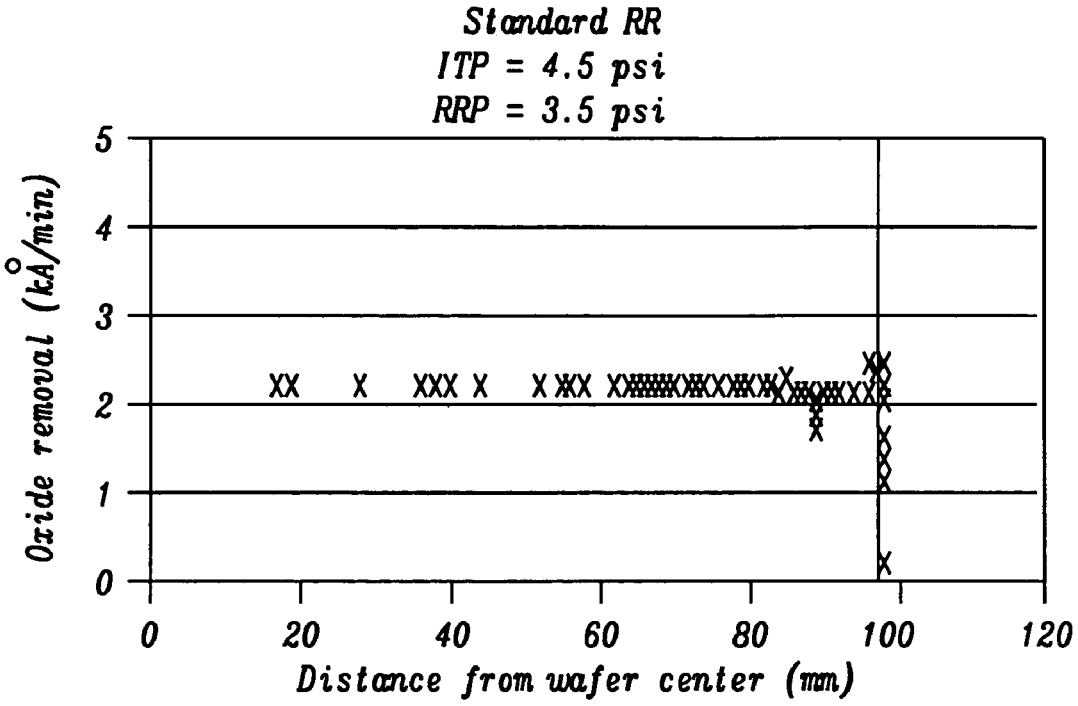
Figure 4H:
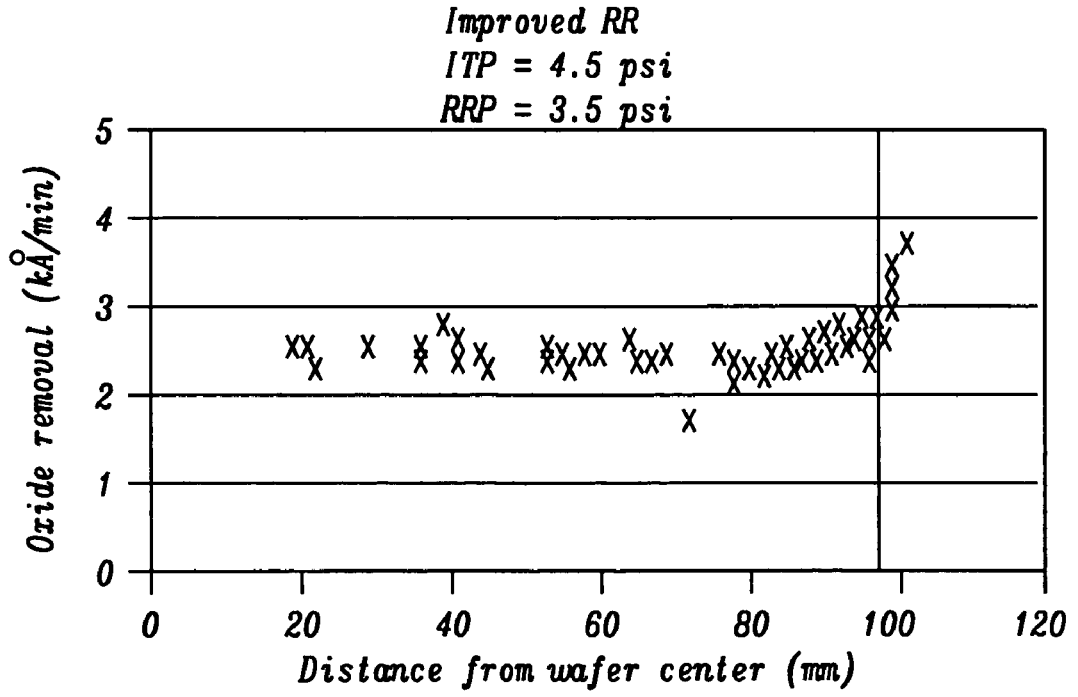
Figure 4I:
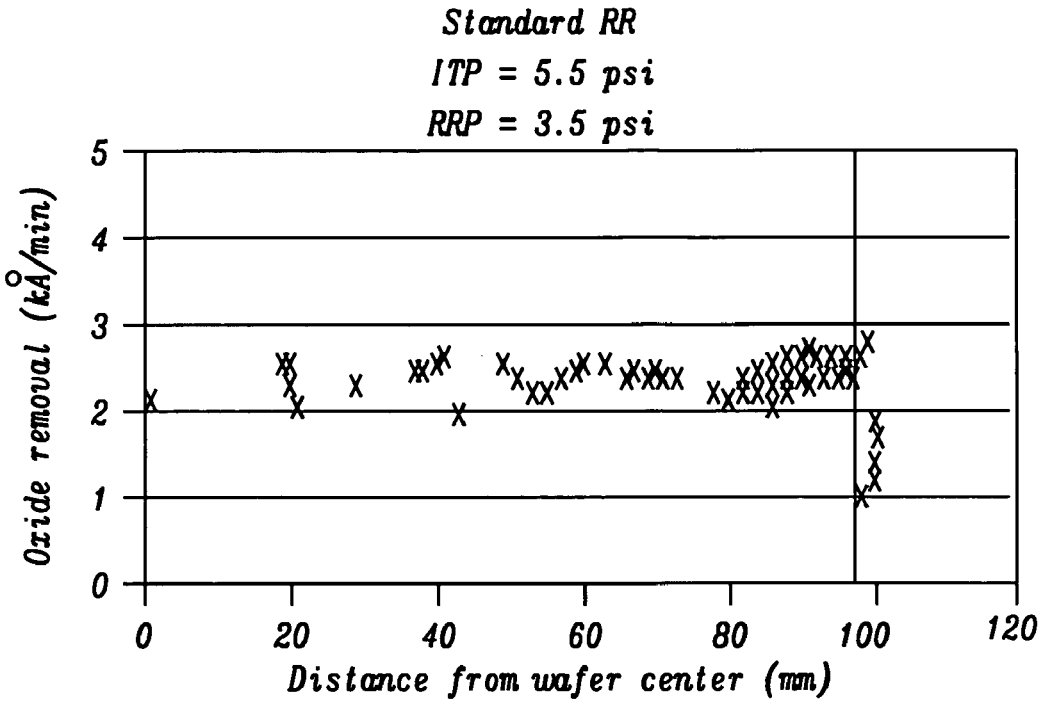
Figure 4J:
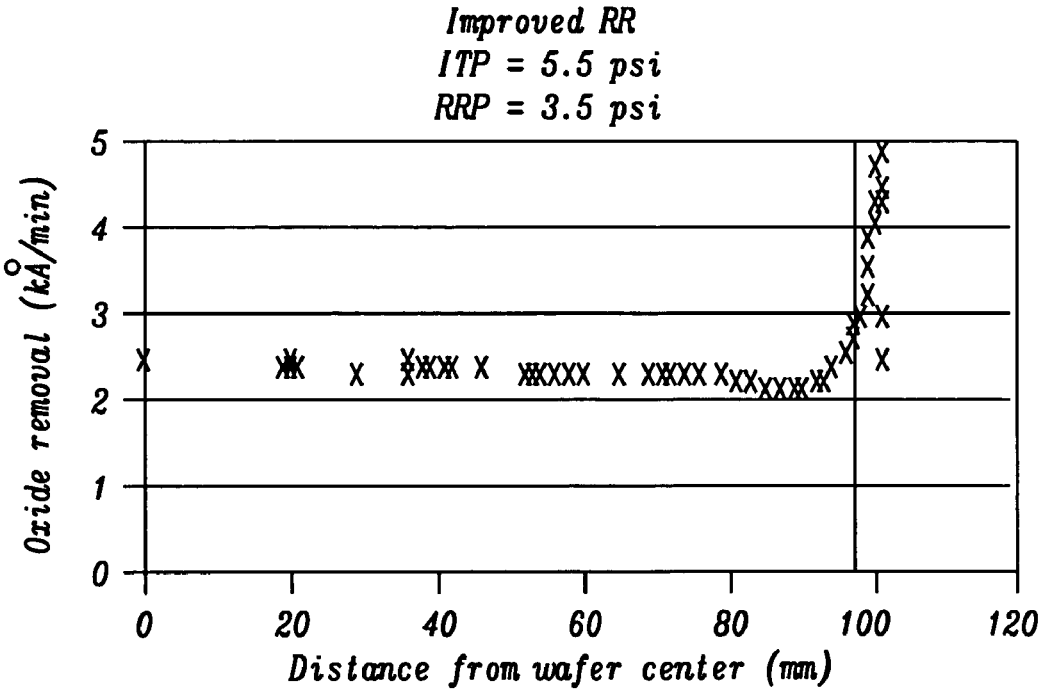

Compared to the standard retaining ring design (FIG. 1*b*) under the same polishing conditions, improved retaining ring design (FIG. 3) demonstrated more flexibility in the oxide polish rate profile control. For the standard retaining ring, it was observed that the polish rate near the wafer edge was always lower compared to that in center region, whereas for improved retaining ring, the overall polish rate profile could be tuned by inner tube pressure (ITP) and retaining ring pressure (RRP) to be wafer edge fast, equal, or slow with respect to that of wafer center. As shown in FIGS. 4*a*, 4*c*, 4*e*, 4*g*, and 4*i*, wherein the RRP is fixed at 3.5 Psi, the standard retaining ring consistently has a lower polish rate in the wafer edge region than in areas further away from the wafer edge. For the improved retaining ring, the polish rate in the wafer edge region varies with ITP. At low ITP) the polish rate in the wafer edge region is lower than that in the wafer center region (FIGS. 4*b* and 4*d*). At higher ITP, the polish rate in the wafer edge region becomes higher than that in the wafer center region (FIGS. 4*h* and 4*j*). Similar trends of polish rate profiles were observed for standard retaining ring and improved retaining ring when the RRP is fixed at 4.5 psi. These results are presented for the standard retaining ring in FIGS. 5*a*, 5*c*, 5*e*, 5*g*, and 5*i* and for the improved retaining ring in FIGS. 5*b*, 5*d*, 5*f*, 5*h*, and 5*j*.

Figure 5A:
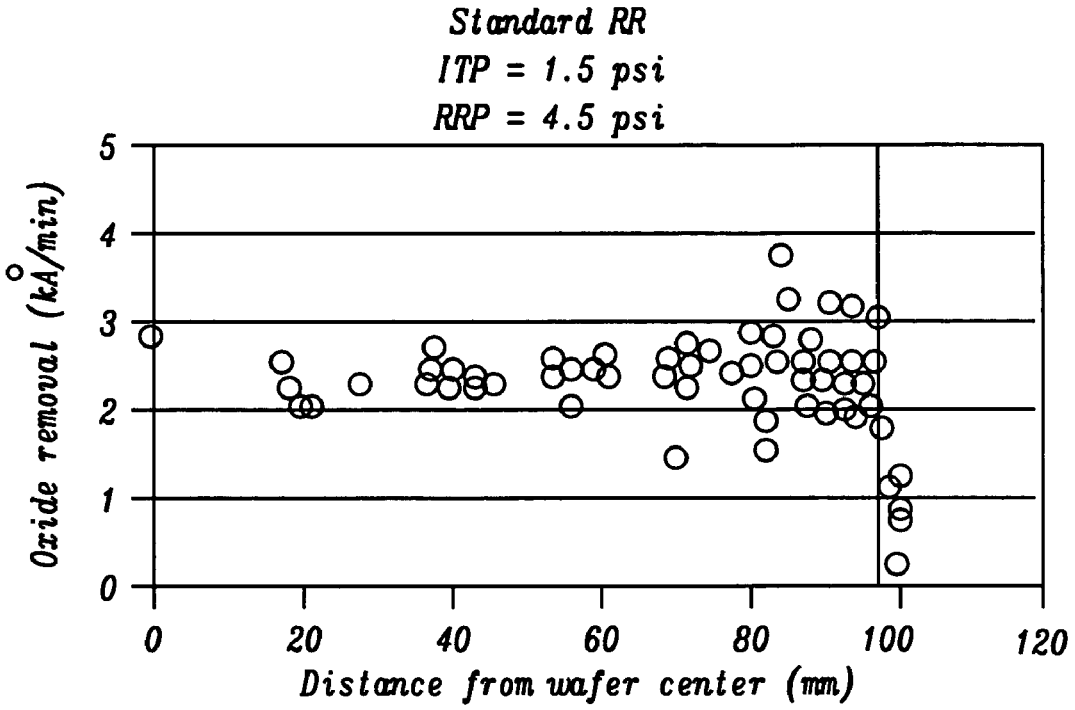
FIGS. 5*a*, 5*c*, 5*e*, 5*g*, and 5*i* are graphs showing polishing rate as a function of distance from the center of a 200 mm. wafer after CMP using a several values of inner tube pressure and a standard retaining ring with 12 slurry channels at a retaining ring pressure of 4.5 psi.
Figure 5B:
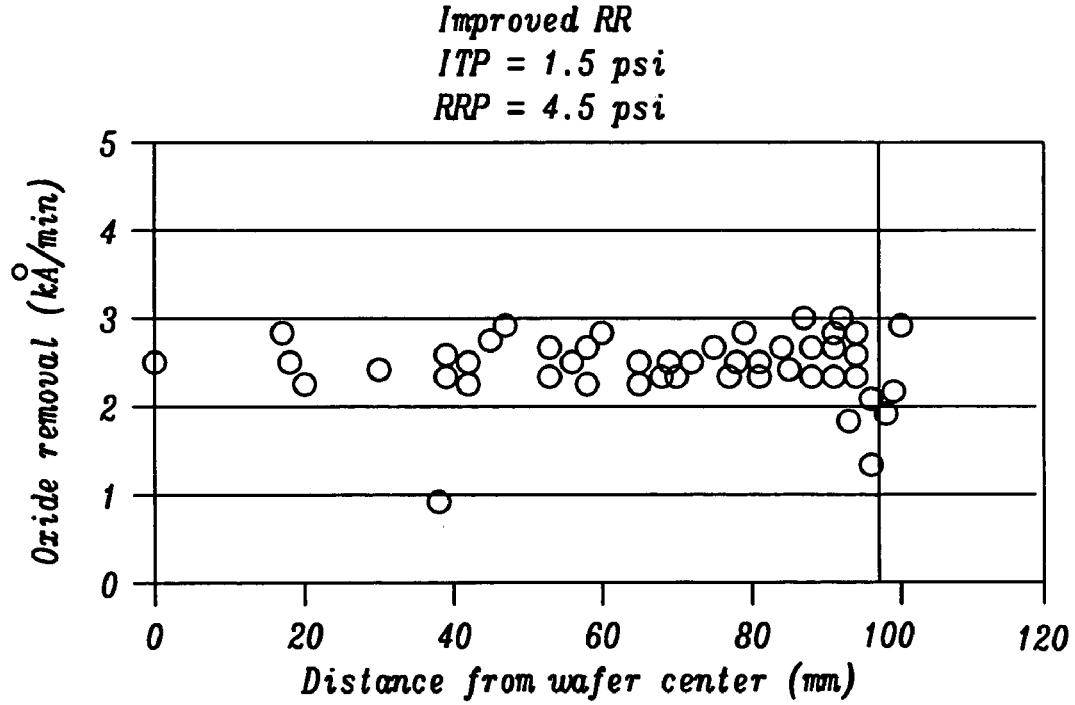
FIGS. 5*b*, 5*d*, 5*f*, 5*h*, and 5*j* are graphs showing polishing rate as a function of distance from the center of a 200 mm. wafer after CMP using a several values of inner tube pressure and the improved retaining ring illustrated in FIG. 3 with 12 slurry channels at a retaining ring pressure of 4.5 psi.
Figure 5C:
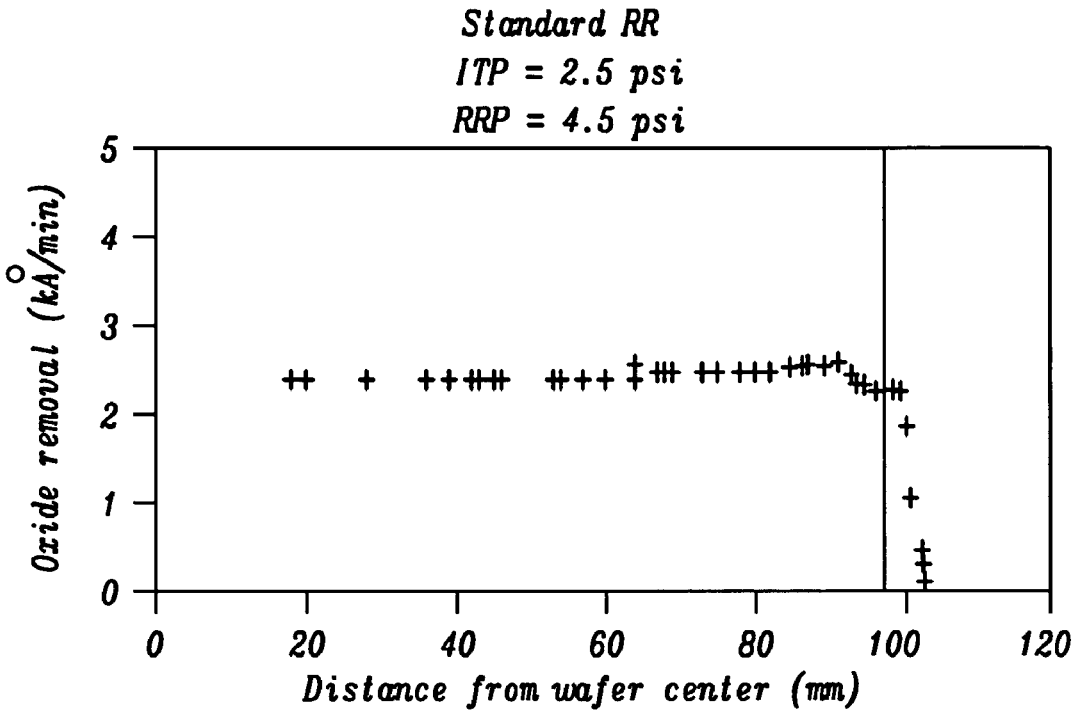
Figure 5D:
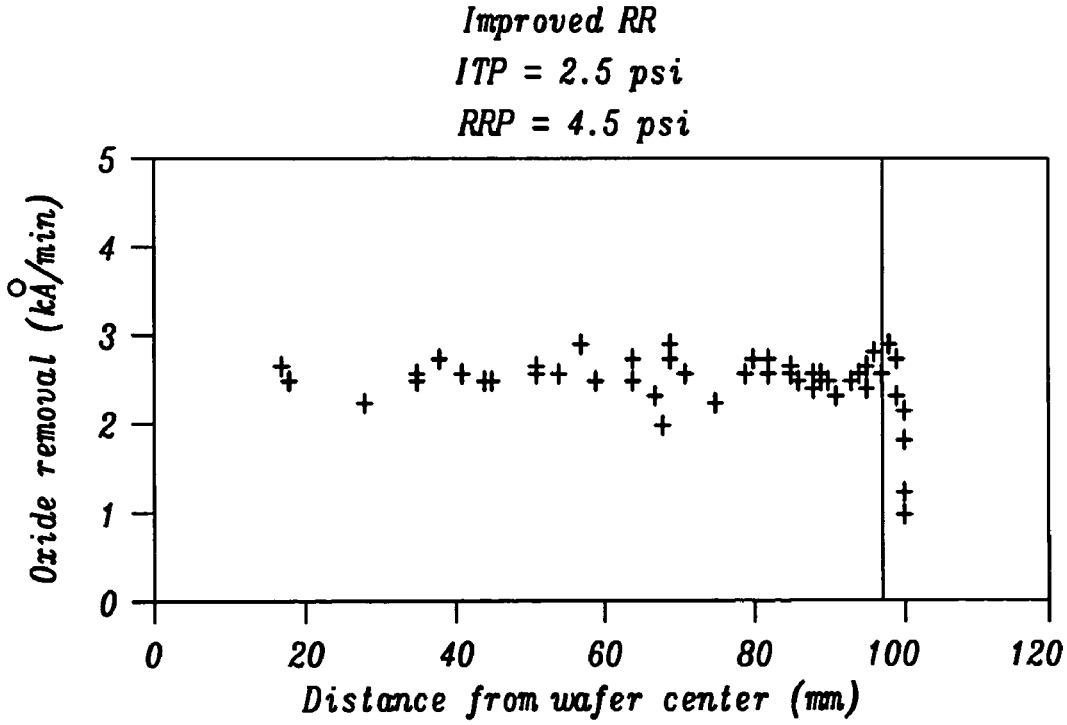
Figure 5E:
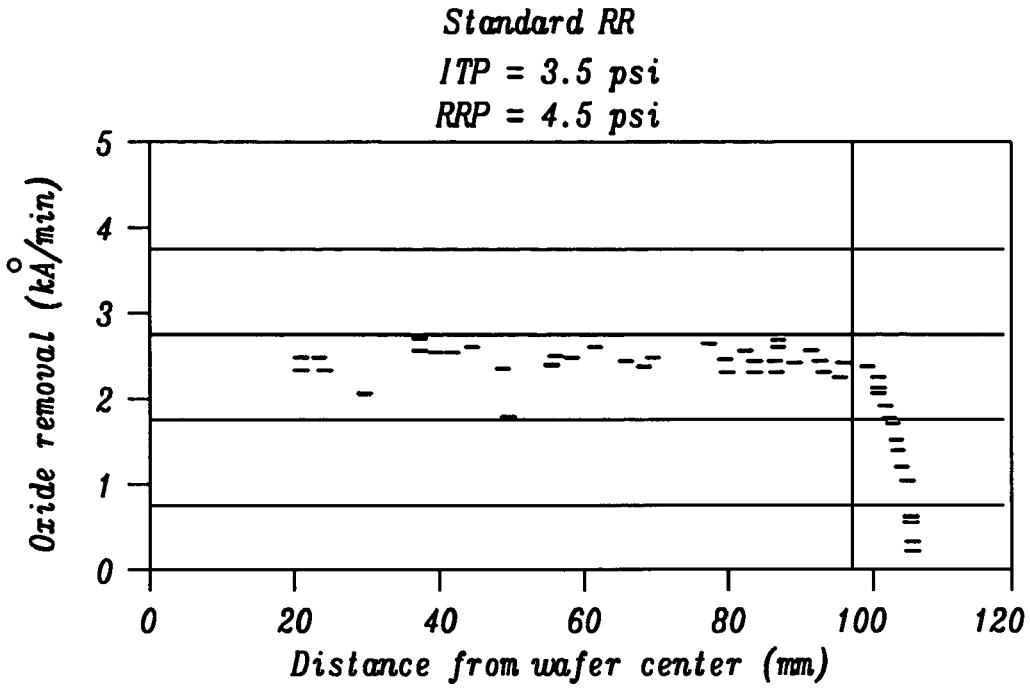
Figure 5F:
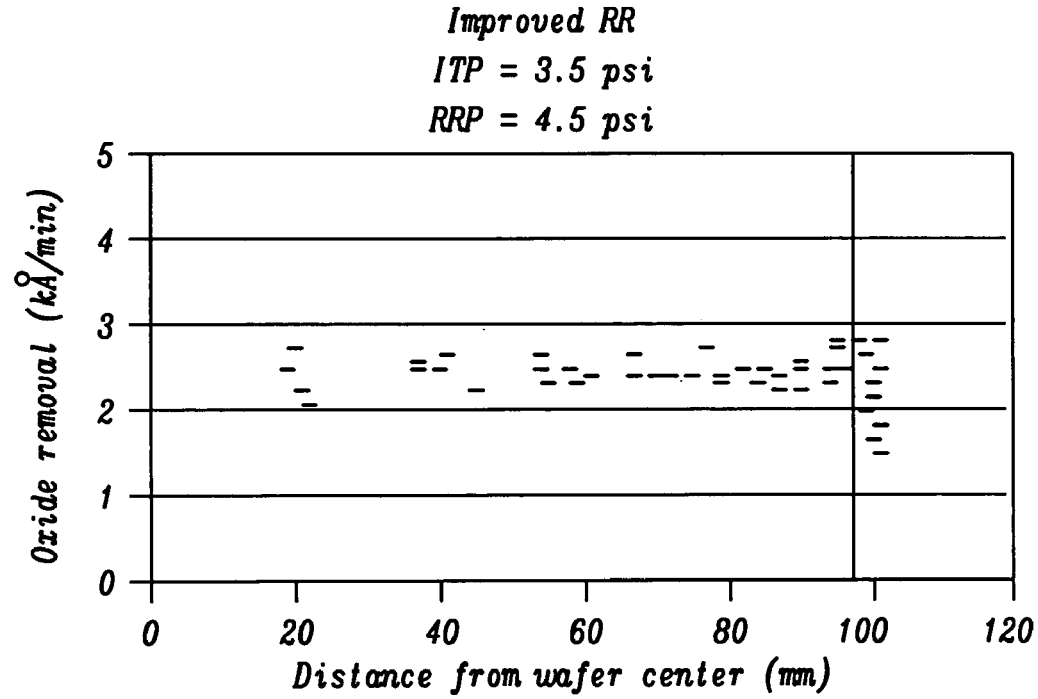
Figure 5G:
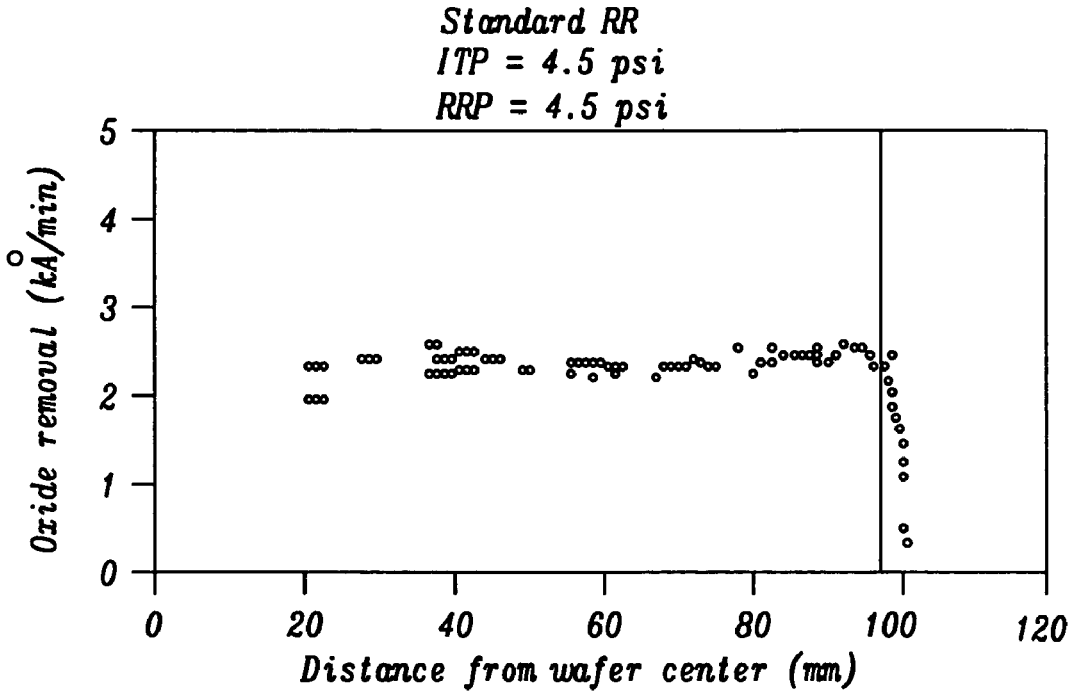
Figure 5H:
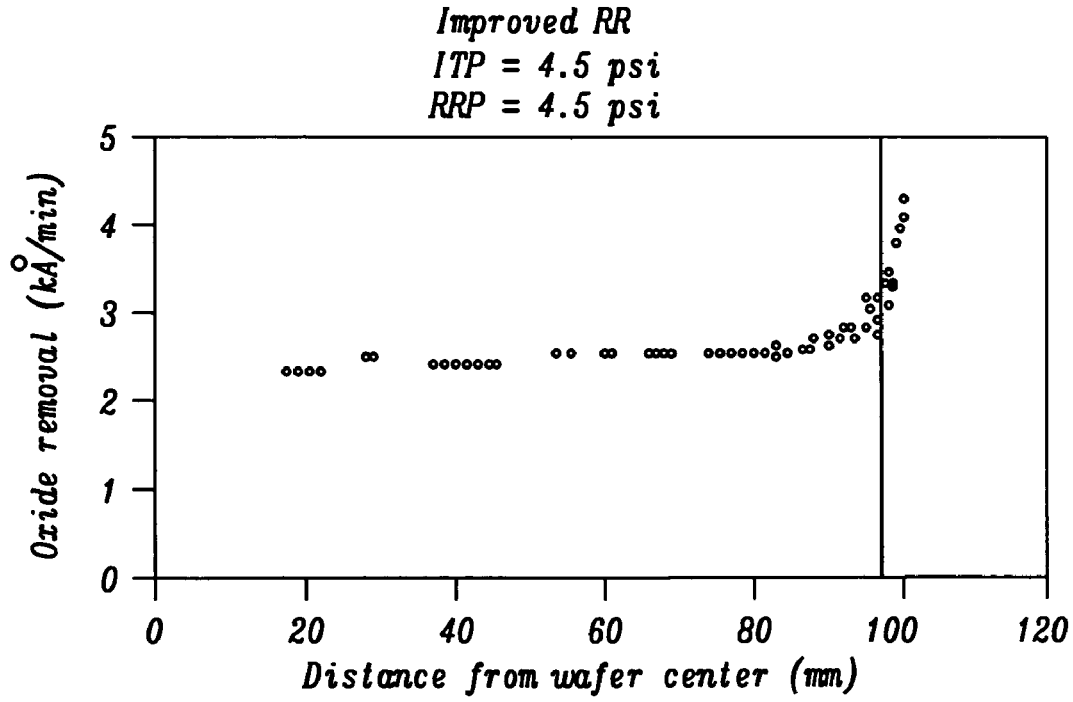
Figure 5I:
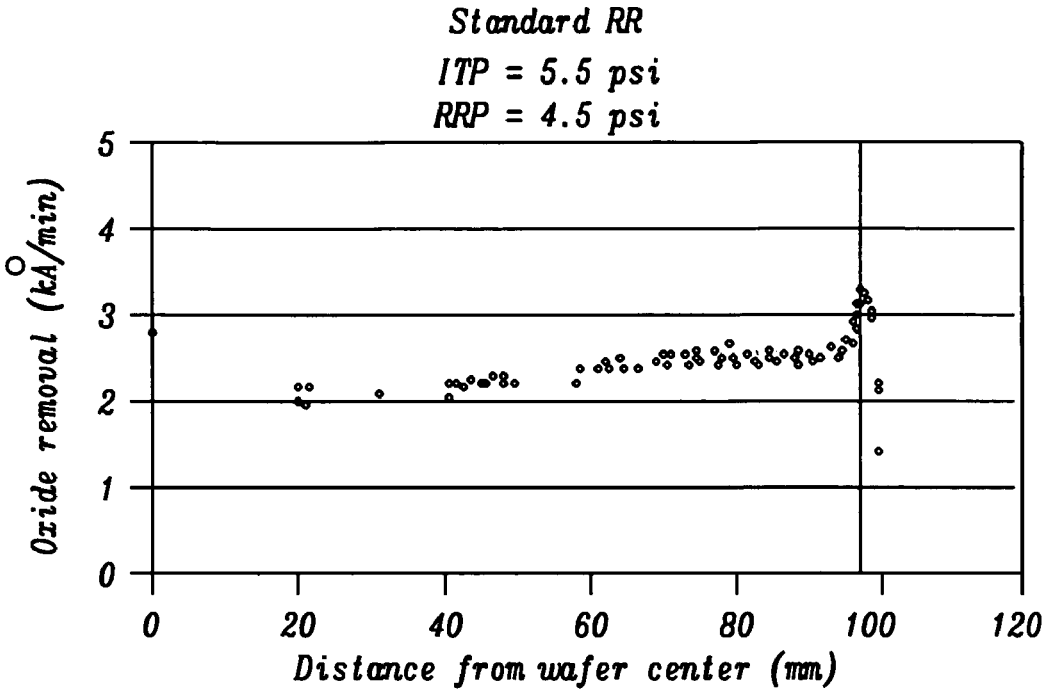
Figure 5J:
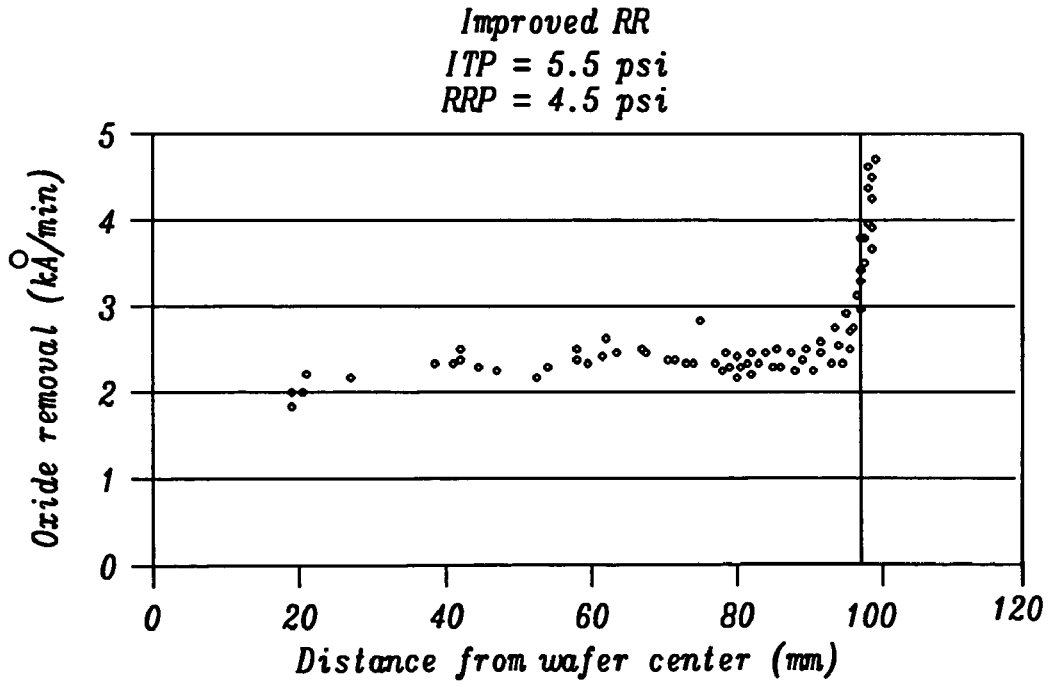
Figure 6:
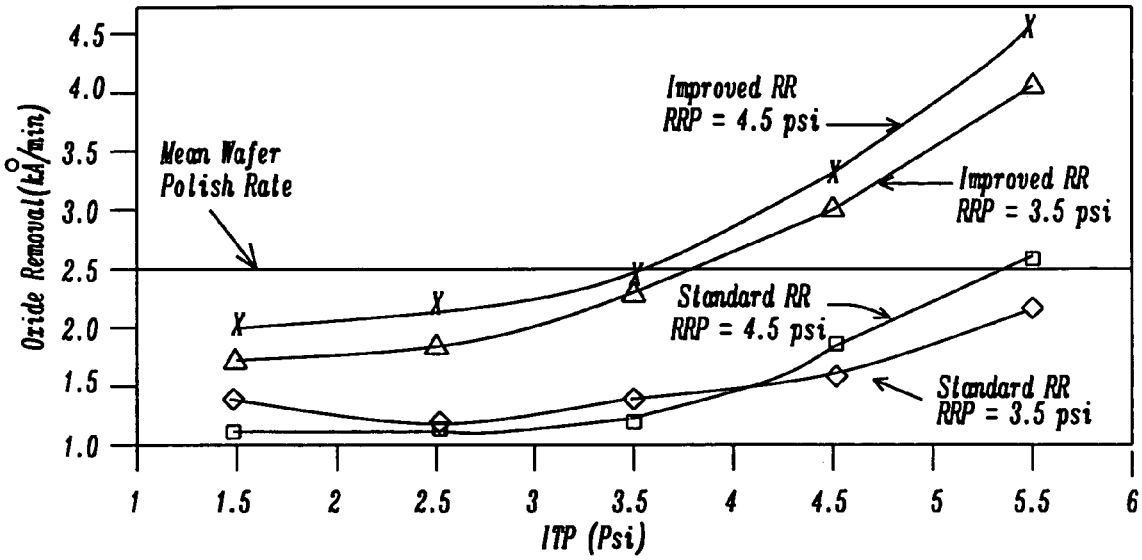
FIG. 6 is a chart showing the variation of the average polishing rate in the edge region as a function of inner tube pressure for the standard and the improved retaining ring.

FIG. 6 shows the average polish rate in the wafer edge region (the average of the polish rates in the region greater than 96 mm. from the center of the wafer) plotted against the inner tube pressure for each of the data sets displayed in FIGS. 4 and 5. The mean wafer polish rate of 2.5 kÅ/min. is also shown as horizontal line to illustrate the better edge control achieved with the improved retaining ring design of the present invention.

Figure 7:
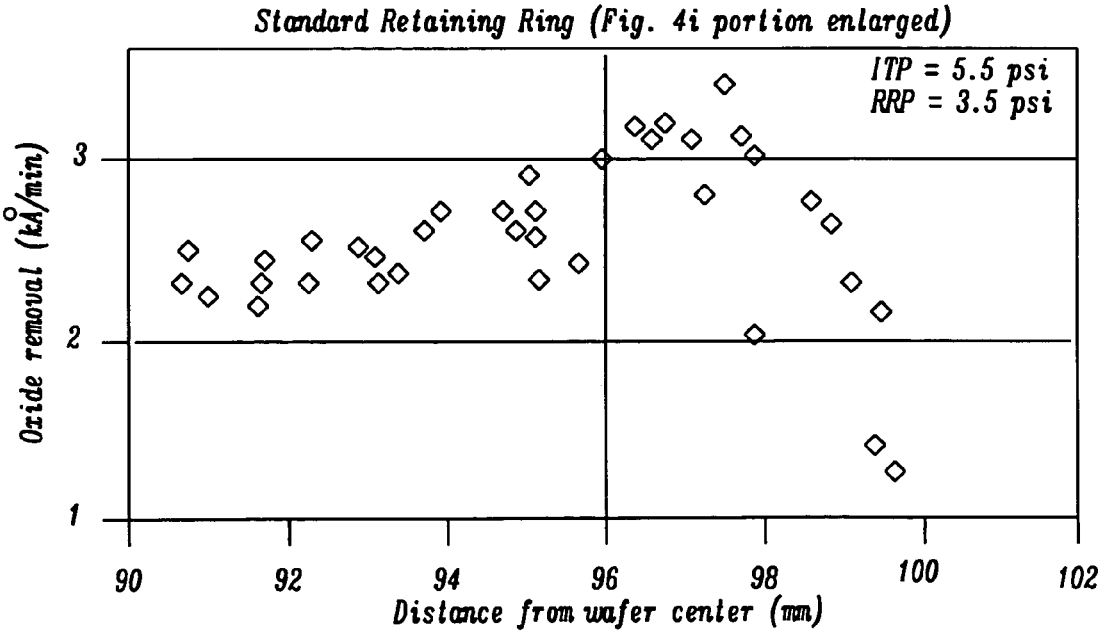
FIG. 7 is a chart showing that, although the data point in FIG. 6 for the average edge polishing rate for the standard retaining ring at 4.5 psi. is greater than the mean polishing rate for the entire wafer.

For standard Retaining ring, under RRP=4.5 psi and ITP=5.5 psi, the edge polish rate seems to be higher than the average polish rate according to FIG. 6. However, the profile data in FIG. 4*i* shows a fall-off in the edge region. This is because the edge polish rate profile under this condition increases beyond the 96 mm. point before the rate finally trends down with respect to the average rate as shown in FIG. 7. Thus the trend in polishing rate for the standard retaining ring is still always downward towards the very edge. This is not found for the improved retaining ring at ITP=5.5 psi and RRP=4.5 psi. However the data in FIG. 4*j* also show a drop off of polish rate at the very edge of the wafer after a steep increase.

The differences in wafer edge polish rate profile between standard Retaining ring and improved Retaining ring suggests that the presence of empty space between the contact segments changes the interaction between wafer and pad under different ITP and RRP.

In the standard retaining ring arrangement, there is pad deformation along the edges of the retaining ring due to the RRP. In addition, the pad deformation is not constant along the radial direction towards wafer center. Such pad deformation causes a small separation between wafer surface and pad near the Retaining ring edge as shown in FIG. 2*a*. This always results in a lower polishing rate at the very edge of the wafer. Slightly away from the wafer edge at areas that are ~94 mm away from wafer center, contact pressure exerted by the pad on wafer is slightly higher and this results in a slightly higher polishing rate at these areas. In the improved retaining ring arrangement, there is also the pad deformation along the edges of the Retaining ring due to the RRP. However, the deformation is away from the wafer edge as shown in FIG. 2*b*. There is better contact between wafer surface and pad, especially around wafer edge. This results in a better response of polish rate around the wafer edge at different inner tube pressures, i.e., high over-polishing at high ITP and high under-polishing at low ITP.

The improved Retaining ring structure is able to provide a complete range of polish rate profile for wafer edge. More specifically, it allows wafer edge polish rate to be adjusted either higher, equal, or lower than the polish rate at the wafer center region. On the other hand, the standard retaining ring always gives low wafer polish rate at wafer edge. The total length of contact segments and the empty space between them on the improved retaining ring plays an important role in allowing different degrees of contact between the polishing pad and the wafer surface around the edges which, in turn, leads to an improved wafer edge polish capability. The improved retaining ring structure is generally applicable in other polisher heads that uses a similar retaining ring to keep the wafers in position during polishing.

While the trend in polishing rate for the standard retaining ring is always downward towards the very edge. This is generally not found for the improved retaining ring at ITP=5.5 psi and RRP=4.5 psi. However the data in FIG. 4*j* also show a drop off of polish rate at the very edge of the wafer after a steep increase well into the edge region. It may be that the polish rate begins to drop off at the extreme edge in all cases but is beyond the capability of the measurements. Nevertheless, the improved retaining ring significantly extends the usable wafer "real estate" at the wafer edge, making this area now useable for integrated circuit product.

The improved retaining ring allows a flat thickness profile to be achieved regardless of the incoming thickness profile (flat, edge thick, or edge thin). In addition, since the polish rate profiles can be varied easily through the retaining ring pressure and the inner tube pressure, polishing conditions can be easily adjusted during polishing to achieve the desired end profiles. The improved retaining ring provides a simpler and cheaper option for better wafer edge polishing rate as well as an increase is useable wafer area.

Figure 8A:
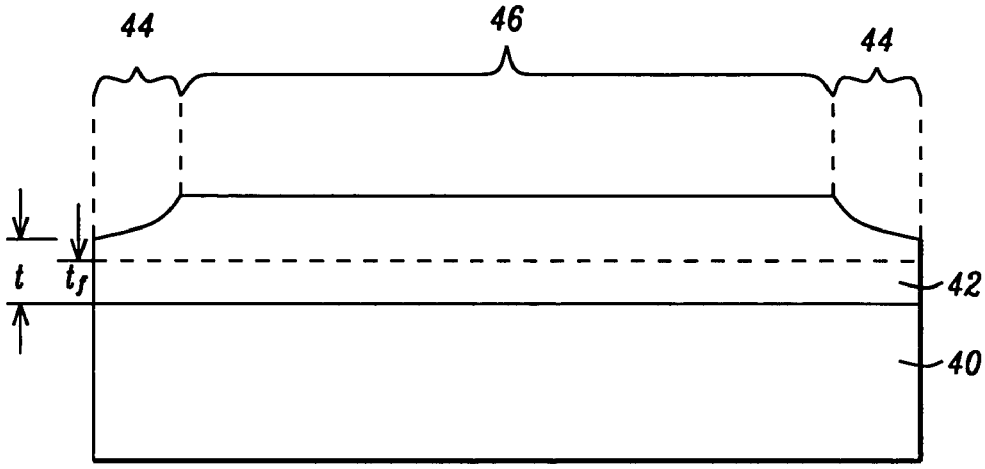
FIGS. 8*a* through 8*c* is a sequence of cross sections showing a wafer undergoing the processing steps described in the second embodiment of this invention.

In a second embodiment of this invention, a method for using the improved retaining ring, described herein, is presented. Referring to FIG. 8*a*, an initially overall planar 200 mm. diameter silicon wafer 40 is provided. Wafer 40 is an "in-process" wafer and may already have one of more levels of manufacture on it. A layer 42 of silicon oxide is deposited onto wafer 40. As deposited, the silicon oxide layer 42 is a thinner in the edge region 44 than in the overall interior region 46. The thickness "t" of the silicon oxide layer in the thinner edge region 44 is greater than a final desired thickness "$t_f$".

Figure 8B:
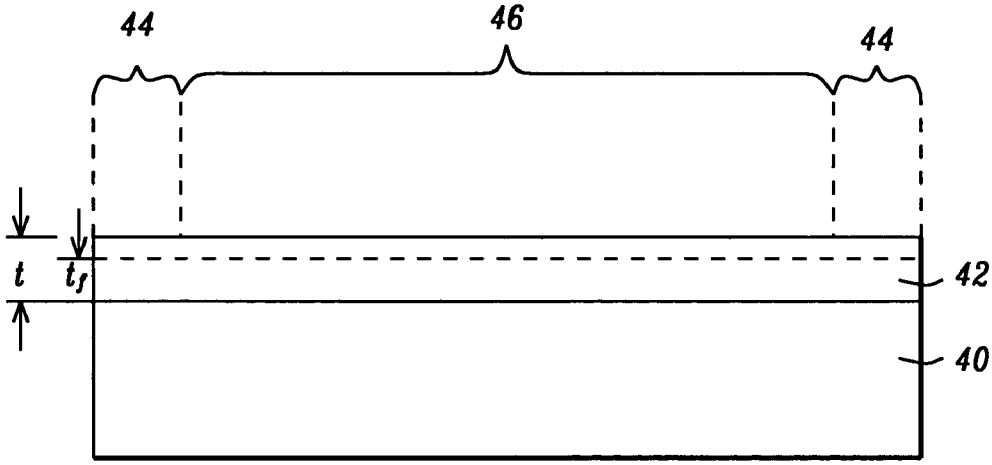
Figure 8C:
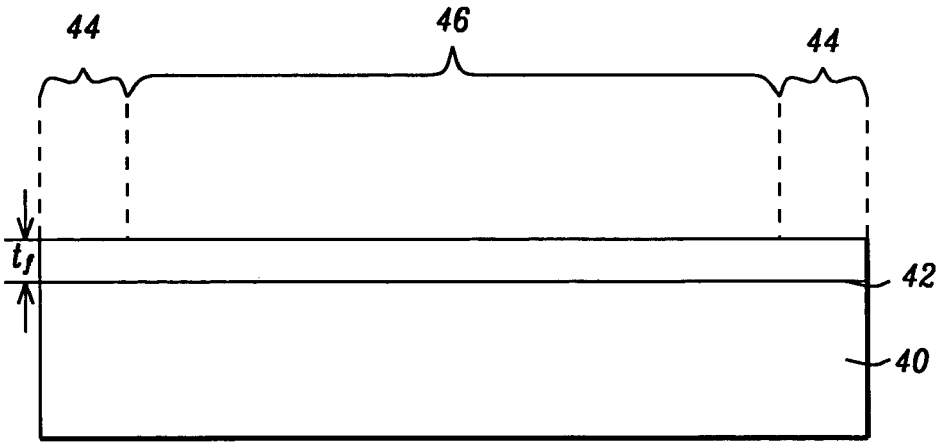

Wafer 40 is next mounted on the head of a CMP polishing machine such as the Mirra-Mesa™ polisher fitted with a Titan-1 polisher head and an improved recessed face retaining ring described by the first embodiment of this invention. The polisher also must have the capability of selectively and independently applying downward pressure (ITP) onto back of a wafer edge, (MP) onto the wafer bulk, and (RRP) onto the improved retaining ring. Using a ILD1300 slurry and the OXP4100 polisher pad, a platen speed of about 110 rpm, a head speed of about 104 rpm., a membrane pressure of about 3 psi., a slurry flow of about 100 ml./min., a ITP of about 4.5 psi. and a RRP of about 4.5 psi., the oxide layer 42 is polished until the surface becomes essentially planar as shown in FIG. 8*b*. Next ITP is changed to about 3.5 psi. and, without changing any of the other parameters, polishing is continued until the final desired thickness "$t_f$" is reached (FIG. 8*c*).

Referring back to FIG. 5, it is shown that the first set of parameters corresponds to the profile FIG. 5*h* wherein the edge region is polished faster than the interior region, leading to an overall planar surface. The second set of parameters corresponds to the FIG. 5*f* profile wherein the edge region is polished at approximately the same rate as the interior region, leads to the final desired thickness. To obtain the same results using an RRP of 3.5 psi., a first polishing period to planarize the surface is accomplished with an ITP of 4.5 psi. (FIG. 4*h*), and then, switching ITP to 3.5 psi. (FIG. 4*f*) would lead the target thickness.

The second embodiment describes a method for planarizing and polishing a layer to a desired thickness wherein the initial surface had an edge region which is thinner than the interior region. It should be understood that, for the reverse case, wherein the edge region is thicker than the interior region, the first set of parameters to use to achieve a planar surface would be of lower ITP such as reflected in FIG. 4*b* or 4*d*, or 5*b*, or 5*d*. The second set of parameters, to achieve a target thickness ($t_f$) would then be the same as those given in the embodiment, namely those which produce uniform polishing for both edge and interior regions (FIG. 4*f* or FIG. 5*f*).

While the embodiments of this invention are described for a 200 mm. diameter wafer, it should be understood that they can be applied to other wafer sizes as well.

While a silicon oxide layer was used to illustrate the second embodiment of this invention, the principles and techniques of the embodiment could be applied to other material layers as well.

While this invention has been particularly shown and described with reference to the preferred embodiments thereof, it will be understood by those skilled in the art that various changes in form and details may be made without departing from the spirit and scope of the invention.

What is claimed is:

1. A retaining ring for a rotatable chemical mechanical polishing head comprising:

(a) an inner peripheral surface;

(b) an outer peripheral surface;

(c) a lower surface adapted to contact and depress an upper surface of a polishing pad during chemical mechanical polishing of the lower surface of a substrate contained within said inner peripheral surface during chemical mechanical polishing; and (d) said lower surface having a even numbered plurality of evenly spaced slurry channels, originating at said outer peripheral surface and angled toward said inner peripheral surface, each of said plurality of evenly spaced slurry channels being radially angled in the direction of rotation of said polishing head, and wherein said plurality of evenly spaced straight slurry channels are further arranged in an alternating sequence of long and short channels, proceeding around the perimeter of said retainer ring, wherein each one of said long channels extends from said inner peripheral surface to said outer peripheral surface and each one of said short channels extends from said outer peripheral surface to a corresponding cavity of a plurality of cavities formed in the lower surface, each one of said plurality of cavities extending from said inner peripheral surface towards said outer peripheral surface for a radial depth and a height above said lower surface sufficient, to prevent depression of a subjacent polishing pad under the edge of a retained wafer adjacent to said cavity, each of said plurality of cavities being further bounded laterally by non-recessed regions which form segmented tabs through which adjacent long channels pass, there being as many segmented tabs as there are long channels, each of said segmented tabs having a rounded edge, tangent to the inner circumference of said retaining ring, meeting said inner circumference at an end of and symmetrical with a non-recessed long channel and whereby each said segmented tab has an effective contact width at said inner peripheral surface against a wafer enclosed therein.

2. The retaining ring of claim 1 fitted for a 200 mm. diameter silicon wafer.

3. The retaining ring of claim 2 wherein said plurality of evenly spaced slurry channels is 12 in number and thereby said retaining ring has 6 recessed channels and 6 non-recessed channels, and 6 symmetrical segmented tabs.

4. The retaining ring of claim 2 wherein the effective contact width of each of said symmetrical segmented tabs is between about 8 and 16 mm. in lieu of an alternate means for retaining said wafer, whereupon the effective contact width could be less than 8 mm.

5. The retaining ring of claim 1 wherein the height of said recessed cavity is between about 1 and 3 mm.

6. The retaining ring of claim 2 wherein the depth of said recessed cavity is about half the total depth of the retaining ring.

7. The retaining ring of claim 1 wherein the preferred total wafer contact length is between about 7 and 15 percent of the inner circumference of said retaining ring in lieu of an alternate means for retaining said wafer, whereupon the contact length could be less than 7 percent of said inner circumference.

8. The retaining ring of claim 1 wherein said evenly spaced slurry channels are straight.

* * * * *

UNITED STATES PATENT AND TRADEMARK OFFICE

CERTIFICATE OF CORRECTION

PATENT NO. : 7,029,375 B2
APPLICATION NO. : 10/930076
DATED : April 18, 2006
INVENTOR(S) : Yew Hoong Phang and Jianguang Chiang It is certified that error appears in the above-identified patent and that said Letters Patent is hereby corrected as shown below:

On the title page:
In the Assignee in item (73), delete "Tech Semiconductor Pte. Ltd., Singapore (SG)" and replace with -- TECH Semiconductor Singapore Pte. Ltd., Singapore (SG) - --.

Signed and Sealed this

First Day of August, 2006

JON W. DUDAS
*Director of the United States Patent and Trademark Office*